US012013223B2

(12) United States Patent
Park

(10) Patent No.: US 12,013,223 B2
(45) Date of Patent: Jun. 18, 2024

(54) APPARATUS AND METHOD FOR CONTROLLING DETONATOR BLASTING BASED ON DANGER RADIUS

(71) Applicant: HANWHA CORPORATION, Seoul (KR)

(72) Inventor: Ki Woong Park, Chungcheongbuk-do (KR)

(73) Assignee: HANWHA CORPORATION, Seoul (KR)

( * ) Notice: Subject to any disclaimer, the term of this patent is extended or adjusted under 35 U.S.C. 154(b) by 0 days.

(21) Appl. No.: 17/623,488

(22) PCT Filed: Dec. 21, 2021

(86) PCT No.: PCT/KR2021/019509
§ 371 (c)(1),
(2) Date: Dec. 28, 2021

(87) PCT Pub. No.: WO2023/120761
PCT Pub. Date: Jun. 29, 2023

(65) Prior Publication Data

US 2024/0044631 A1 Feb. 8, 2024

(51) Int. Cl.
*F42D 5/00* (2006.01)
*F42D 1/045* (2006.01)

(52) U.S. Cl.
CPC ..... *F42D 5/00* (2013.01); *F42D 1/045* (2013.01)

(58) Field of Classification Search
CPC ... E21B 44/00; F42D 1/08; F42D 1/06; F42D 1/045; F42D 5/00
USPC .... 102/313, 312, 311, 222, 218, 215, 202.1, 102/200; 89/1.151, 15
See application file for complete search history.

(56) References Cited

U.S. PATENT DOCUMENTS 6,957,707 B2 * 10/2005 Koivunen ..... E21B 7/022 175/38
2005/0103219 A1 * 5/2005 McClure ..... F42D 1/055 102/311
2010/0078215 A1 * 4/2010 Saleniemi ..... E21B 44/00 703/1
2012/0024181 A1 * 2/2012 Von Lengeling ..... F42D 1/10 102/311

(Continued)

FOREIGN PATENT DOCUMENTS

KR 10-1749406 B1 6/2017
KR 10-2129304 B1 7/2020
KR 10-2129306 B1 7/2020

*Primary Examiner* — John Cooper
(74) *Attorney, Agent, or Firm* — WHDA, LLP

(57) ABSTRACT

The present disclosure relates to an apparatus and method for controlling detonator blasting based on a danger radius, the apparatus including a danger radius setting unit that sets a danger radius for a detonator or a communication module, a blasting area setting unit that sets a blasting area in which a preset danger radius is reflected in a location value input during registration of the detonator or the communication module, an equipment location determination unit that determines a location of equipment possessed by an operator, and a blasting start control unit that controls so that blasting of the detonator is allowed only when the equipment is not located within the set blasting area as a result of the determination.

5 Claims, 5 Drawing Sheets

(56) References Cited

U.S. PATENT DOCUMENTS

| | | | | |
|---|---|---|---|---|
| 2014/0026775 | A1* | 1/2014 | Papillon | F42D 1/055 102/215 |
| 2016/0209195 | A1* | 7/2016 | Kruger | G06F 3/167 |
| 2021/0080241 | A1* | 3/2021 | Park | F42D 1/055 |
| 2021/0102792 | A1* | 4/2021 | Guyon | F42D 1/04 |
| 2021/0231426 | A1* | 7/2021 | Kuk | F42D 5/00 |

* cited by examiner

APPARATUS AND METHOD FOR CONTROLLING DETONATOR BLASTING BASED ON DANGER RADIUS

TECHNICAL FIELD

One aspect of the present disclosure relates to an apparatus and method for controlling detonator blasting based on a danger radius, and more particularly, to an apparatus and method for setting a blasting area in which a preset danger radius is reflected in a location value input during registration of a detonator or a communication module and controlling so that detonator blasting is allowed only when equipment possessed by an operator is not located within the set blasting area as a result of determining a location of the equipment.

BACKGROUND ART

In general, explosives are used for construction such as blasting of bedrock, blasting of abandoned buildings and the like. That is, blasting objects are classified for each section and a plurality of holes into which explosives are inserted are drilled. After inserting the explosives respectively into the drilled holes, the explosives are connected to a blasting system. The explosives are detonated through an operation of the blasting system to detonate the blasting object.

The blasting system is configured to include a detonator that is a detonating agent for detonating an explosive, a power supply necessary for the operation of the detonator, and a blasting device that transmits a command to the detonator. In this case, an electronic detonator is mainly used as the detonator of the blasting system. The electronic detonator is installed on an explosive side, and a plurality of electronic detonators are connected to one blasting device.

The electronic detonator has a structure in which, when a command is transmitted from the blasting device, a plurality of electronic detonators connected to the blasting device operate simultaneously to detonate explosives at the same time, and a structure in which the plurality of electronic detonators are set with different delay times and the plurality of electronic detonators are sequentially operated to sequentially detonate the explosives.

In this regard, Korean Patent Application Laid-Open Publication No. 2020-0076370 discloses "a wireless blasting system and an operation method thereof".

DISCLOSURE

Technical Problem

In order to solve the above problems, an object of one aspect of the present disclosure is to provide an apparatus and method for controlling detonator blasting based on a danger radius, that sets an area of a rectangle circumscribed about a circle formed by a preset danger radius based on a location value input during registration of a detonator or a communication module as a blasting area.

In addition, an object of one aspect of the present disclosure is to provide an apparatus and method for controlling detonator blasting based on a danger radius, that controls so that detonator blasting is allowed only when the equipment is not located within the set blasting area and located outside a preset boundary distance.

In addition, an object of one aspect of the present disclosure is to an apparatus and method for controlling detonator blasting based on a danger radius, that provides a warning notification including information on a current location of an operator and a distance to a location out of the blasting area and the preset boundary distance based on the current location to the operator's terminal when the equipment is located within the set blasting area.

Technical Solution

In order to accomplish the above object, there is provided an apparatus for controlling detonator blasting based on a danger radius according to the present disclosure for achieving the above object including a danger radius setting unit that sets a danger radius for a detonator or a communication module, a blasting area setting unit that sets a blasting area in which a preset danger radius is reflected in a location value input during registration of the detonator or the communication module, an equipment location determination unit that determines a location of equipment possessed by an operator, and a blasting start control unit that controls so that blasting of the detonator is allowed only when the equipment is not located within the set blasting area as a result of the determination.

In addition, it is characterized in that the blasting area setting unit sets an area of a rectangle circumscribed about a circle formed by the preset danger radius based on the location value input during registration of the detonator or the communication module as the blasting area.

In addition, it is characterized in that the blasting area setting unit, whenever the detonator or the communication module is additionally registered, updates the blasting area by reflecting the preset danger radius in the location value input during the registration.

In addition, it is characterized in that the equipment determination unit determines whether or not the location of the equipment possessed by the operator is located within the set blasting area.

In addition, it is characterized in that the blasting start control unit controls so that blasting of the detonator is allowed only when the equipment is not located within the set blasting area and located outside a preset boundary distance.

In addition, it is characterized in that the apparatus for controlling detonator blasting based on the danger radius includes a warning notification providing unit that provides a warning notification including guidance on blasting impossibility, a current location of an operator, and information on a distance to a location out of the blasting area and a preset boundary distance based on the current location to the operator's terminal when the equipment is located within the set blasting area or at a preset boundary distance as a result of the determination.

There is provided a method for controlling detonator blasting based on a danger radius according to the present disclosure for achieving the above object including the steps of setting, by a danger radius setting unit, a danger radius for a detonator or a communication module, setting, by a blasting area setting unit, a blasting area in which a preset danger radius is reflected in a location value input during registration of the detonator or the communication module, determining, by an equipment location determination unit, a location of equipment possessed by an operator, and controlling, by a blasting start control unit, so that blasting of the detonator is allowed only when the equipment is not located within the set blasting area as a result of the determination.

In addition, it is characterized in that, in the step of setting the blasting area in which the preset danger radius is reflected in the location value input during registration of the detonator or the communication module, an area of a rectangle circumscribed about a circle formed by the preset danger radius based on the location value input during registration of the detonator or the communication module is set as the blasting area.

In addition, it is characterized in that, the step of setting the blasting area in which the preset danger radius is reflected in the location value input during registration of the detonator or the communication module includes a step of updating the blasting area by reflecting the preset danger radius in the location value input during the registration whenever the detonator or the communication module is additionally registered.

In addition, it is characterized in that, in the step of controlling so that blasting of the detonator is allowed only when the equipment is not located within the set blasting area as a result of the determination, control is made so that blasting of the detonator is allowed only when the equipment is not located within the set blasting area and located outside a preset boundary distance.

In addition, it is characterized in that, after the step of determining the location of the equipment possessed by the operator, a warning notification including guidance on blasting impossibility, a current location of an operator, and information on a distance to a location out of the blasting area and a preset boundary distance based on the current location is provided to the operator's terminal when the equipment is located within the set blasting area or at the preset boundary distance as a result of the determination.

Advantageous Effects

According to an embodiment of the present disclosure, the apparatus and method for controlling detonator blasting based on the danger radius for achieving the above object have an effect of flexibly setting the blasting area according to the registered detonator by setting the area of the rectangle circumscribed about the circle formed by the preset danger radius based on the location value input during registration of the detonator or the communication module as the blasting area, and updating the blasting area by reflecting the preset danger radius in the location value input during the registration whenever the detonator or the communication module is additionally registered.

According to an embodiment of the present disclosure, the apparatus and method for controlling detonator blasting based on the danger radius for achieving the above object have an effect of improving stability of the detonator blasting operation and minimizing a human error by enabling the detonator blasting only when the equipment is not located within the set blasting area and located outside the preset boundary distance, and providing the waning notification including the current location of the operator and information on the distance to the location out of the blasting area and the preset boundary distance based on the current location to the operator's terminal when the equipment is located within the set blasting area.

DESCRIPTION OF REFERENCE NUMERALS

Figure 1:
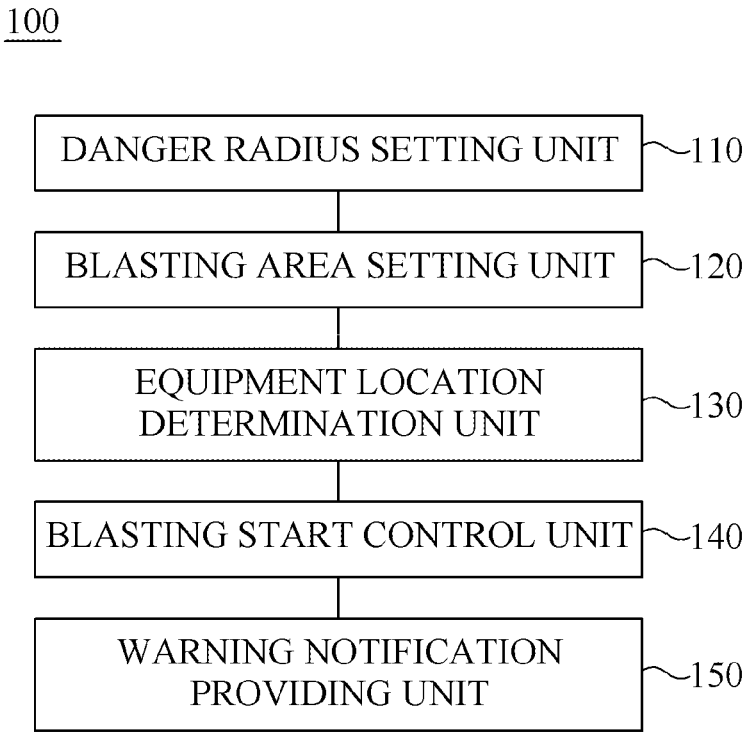
FIG. 1 is a diagram for illustrating a configuration of an apparatus for controlling detonator blasting based on a danger radius according to the present invention.

100: Apparatus for controlling detonator blasting based on danger radius
110: Danger radius setting unit
120: Blasting area setting unit
130: Equipment location determination unit
140: Blasting start control unit
150: Warning notification providing unit

BEST MODE

Since various modifications may be made to the present disclosure and various embodiments may be derived from the present disclosure, specific embodiments are illustrated in the drawings and described in detail.

However, this is not intended to limit the present disclosure to specific embodiments, it should be understood to include all modifications, equivalents and substitutes included in the spirit and scope of the present disclosure. In describing each figure, like reference numerals have been used for like components.

When a component is referred to as being "connected" or "coupled" to another component, it may be directly connected or coupled to the other component, but it should be understood that other elements may exist in the middle. On the other hand, when a component is referred to as being "directly connected" or "directly coupled" to another element, it should be understood that no other component is present in the middle.

The terms used in the present application are only used to describe specific embodiments, and are not intended to limit the present disclosure. The singular expression includes the plural expression unless the context clearly dictates otherwise. It should be understood that, in the present application, terms such as "comprise" or "have" are intended to designate the presence of a feature, number, step, operation, component, part, or combination thereof described in the specification, and do not preclude the possibility of the presence or addition of one or more other features or numbers, steps, operations, components, parts, or combinations thereof.

Hereinafter, with reference to the accompanying drawings, a preferred embodiment of the present disclosure will be described in more detail. Hereinafter, the same reference numerals are used for the same components in the drawings, and redundant descriptions of the same components are omitted.

Figure 2:
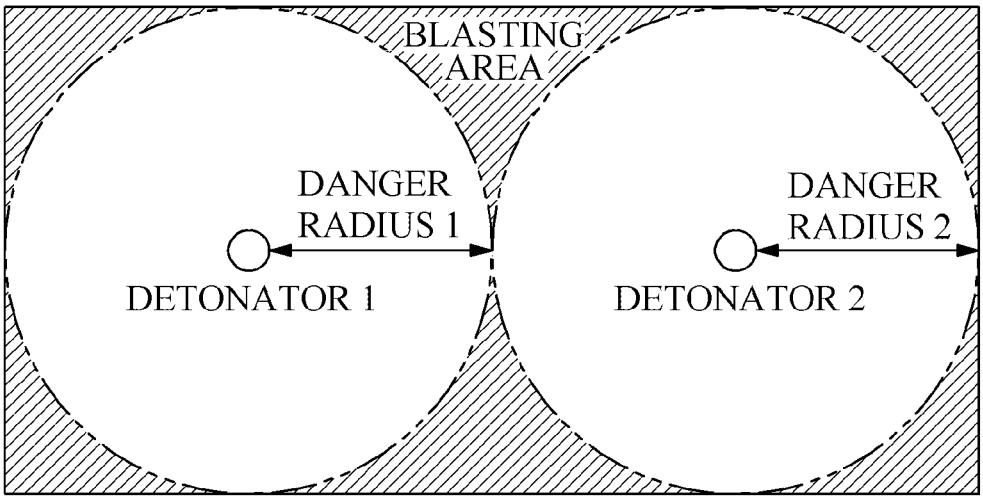
FIG. 2 is a diagram for illustrating a function of a blasting area setting unit adopted in the apparatus for controlling detonator blasting based on the danger radius according to the present invention.
Figure 3:
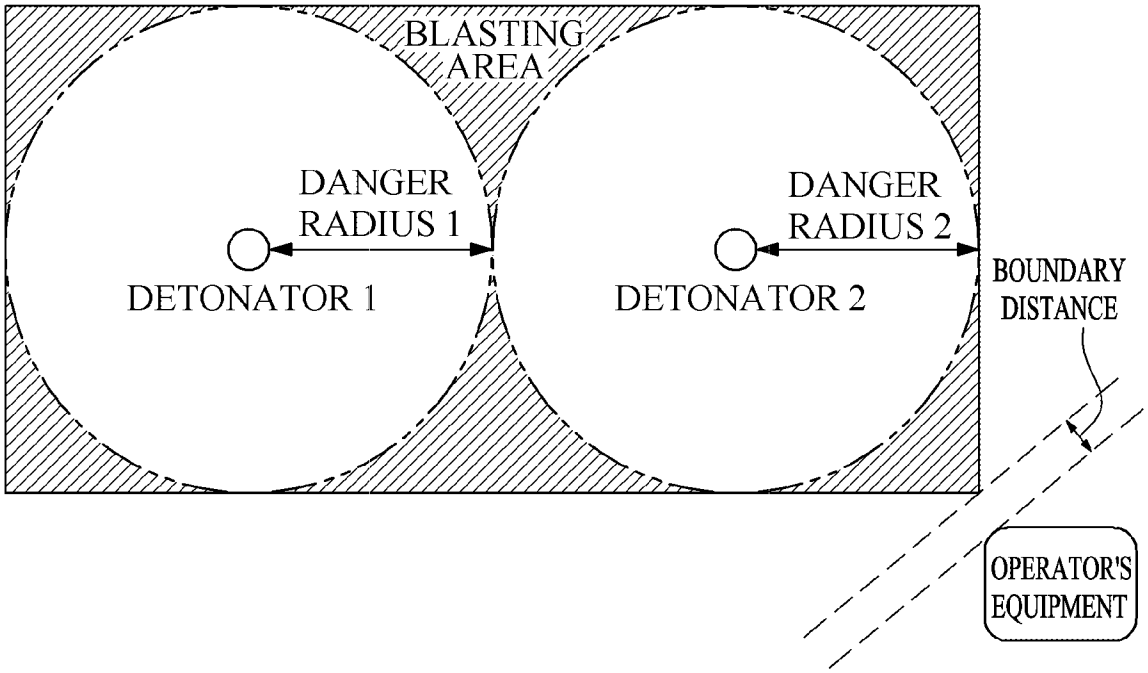
FIG. 3 is a diagram for illustrating a function of a blasting start control unit adopted in the apparatus for controlling detonator blasting based on the danger radius according to the present invention.

FIG. 1 is a diagram for illustrating a configuration of an apparatus for controlling detonator blasting based on a danger radius according to the present disclosure, FIG. 2 is a diagram for illustrating a function of a blasting area setting unit adopted in the apparatus for controlling detonator blasting based on the danger radius according to the present disclosure, and FIG. 3 is a diagram for illustrating a function of a blasting start control unit adopted in the apparatus for controlling detonator blasting based on the danger radius according to the present disclosure.

When description is made with reference to FIG. 1, an apparatus 100 for controlling detonator blasting based on a danger radius according to the present disclosure largely includes a danger radius setting unit 110, a blasting area setting unit 120, an equipment location determination unit 130, a blasting start control unit 140, and a warning notification providing unit 150.

The danger radius setting unit 110 sets the danger radius for a detonator or a communication module. In this case, the set danger radius is set to beat least 100 m, but is not limited thereto.

The blasting area setting unit 120 sets a blasting area in which a preset danger radius is reflected in a location value input during registration of the detonator or the communication module.

As illustrated in FIG. 2, the blasting area setting unit 120 sets an area of a rectangle circumscribed a circle formed by the preset danger radius based on the location value input during registration of the detonator or communication module as the blasting area.

The blasting area setting unit 120 may update the blasting area by reflecting the preset danger radius in the location value input during the registration whenever the detonator or the communication module is additionally registered.

The equipment location determination unit 130 determines a location of equipment possessed by an operator.

The equipment location determination unit 130 determines whether or not the location of the equipment possessed by the operator is located within the set blasting area and a boundary distance that is a safety distance between the blasting area and the equipment. In this case, the equipment possessed by the operator may be a tracker or a blaster interlocked with the detonator, etc.

The blasting start control unit 140 controls so that blasting of the detonator is allowed only when the equipment is not located within the set blasting area as a result of the determination.

As illustrated in FIG. 3, the blasting start control unit 140 controls so that blasting of the detonator is allowed only when the equipment is not located within the set blasting area and is also located outside the preset boundary distance. Here, the boundary distance is a safety distance between the blasting area and the equipment, and can be set variously by the operator depending on the specifications of the detonator and a communicable distance between the detonator and the equipment.

The warning notification providing unit 150 provides a warning notification to an operator's terminal when the equipment is located within the set blasting area as a result of the determination.

Figure 4:
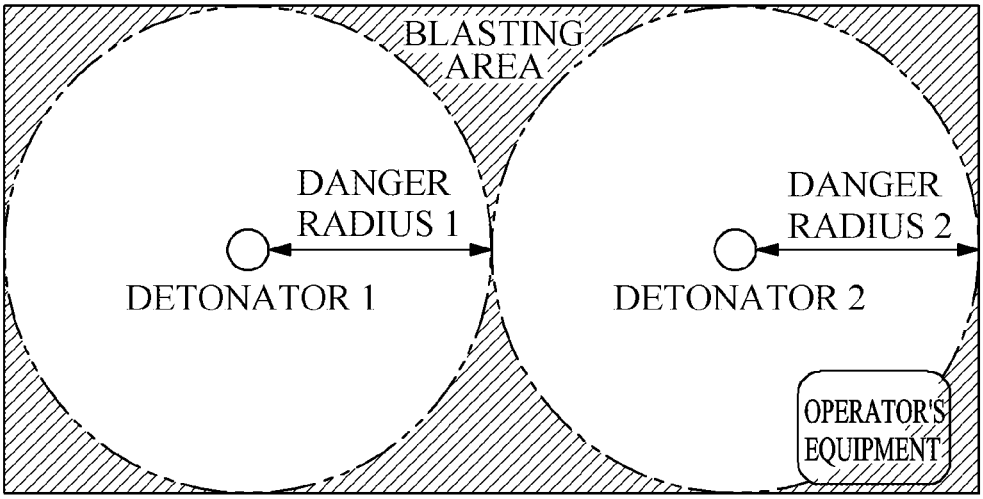
FIG. 4 is a diagram for illustrating a function of a warning notification providing unit adopted in the apparatus for controlling detonator blasting based on the danger radius according to the present invention.

As illustrated in FIG. 4, the warning notification providing unit 150 provides a warning notification including guidance on blasting impossibility, a current location of an operator, and information on a distance to a location out of the blasting area and the preset boundary distance based on the current location to the operator's terminal when the equipment is located within the set blasting area or at the preset boundary distance.

Figure 5:
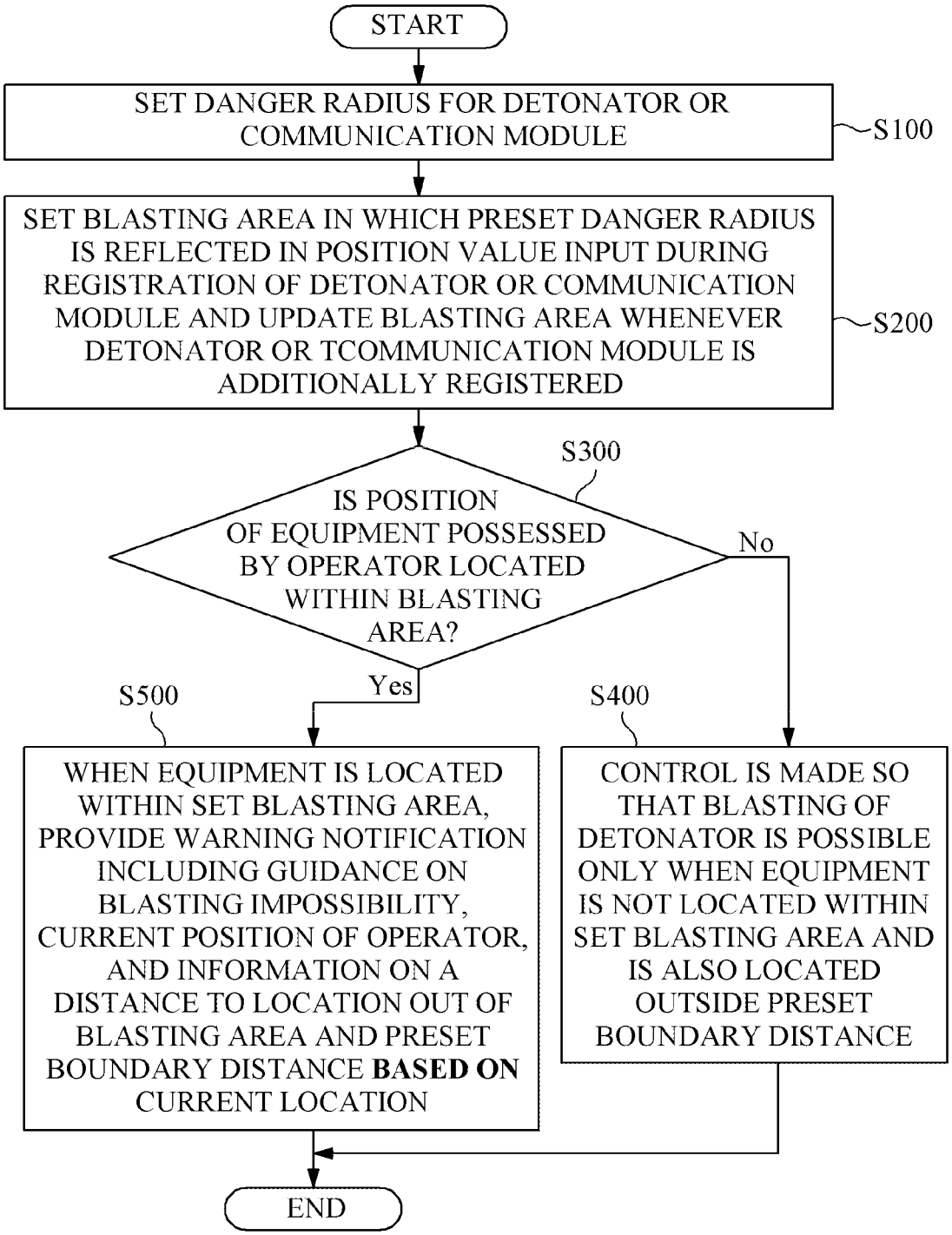
FIG. 5 is a diagram for illustrating a sequence of a method for controlling detonator blasting based on a danger radius according to the present invention.

FIG. 5 is a diagram for illustrating a sequence of a method for controlling detonator blasting based on a danger radius according to the present disclosure.

When description is made with reference to FIG. 5, the sequence of the method for controlling the detonator blasting based on the danger radius according to the present disclosure is performed using the apparatus for controlling the detonator blasting based on the danger radius described above, and the redundant description below will be omitted.

First, a danger radius for the detonator or communication module is set (S100). In this case, the danger radius is set to be at least 100 m, but is not limited thereto.

Next, the blasting area in which the preset danger radius is reflected in a location value input during registration of the detonator or the communication module is set (S200).

In step S200, an area of a rectangle circumscribed about the circle formed by the preset danger radius based on the location value input during registration of the detonator or communication module may be set as the blasting area, and the blasting area may be updated by reflecting the preset danger radius in the location value input during the registration whenever the detonator or the communication module is additionally registered.

Next, it is determined whether or not the location of the equipment possessed by the operator is located within the set blasting area (S300).

In Step S300, it is determined whether or not the location of the equipment possessed by the operator is located within the set blasting area and the boundary distance that is the safety distance between the blasting area and the equipment.

In Step S300, control is made so that blasting of the detonator is allowed only when the equipment is not located within the set blasting area as a result of the determination (S400).

In Step S400, control is made so that blasting of the detonator is allowed only when the equipment is not located within the set blasting area and is also located outside the preset boundary distance.

In Step S300, when the equipment is located within the set blasting area as a result of the determination, a warning notification is provided to the operator's terminal (S500).

In Step S500, when the equipment is located within the set blasting area or at the preset boundary distance, a warning notification, which includes guidance on blasting impossibility, a current location of an operator, and information on a distance to a location out of the blasting area and the preset boundary distance based on the current location, is provided to the operator's terminal.

The functional operations and embodiments related to the subject matter described in this specification may be implemented by digital electronic circuitry or computer software, firmware or hardware, including structures disclosed in this specification and structural equivalents thereof, or in combination of one or more of these components.

The embodiments of the subject matter described in this specification may be implemented as one or more computer program products, i.e., one or more modules of computer program instructions encoded on a tangible program medium for execution by a data processing device or for controlling its operation. The tangible program medium may be a propagating signal or a computer-readable medium. The propagating signal is an artificially generated signal, e.g., a machine-generated electrical, optical or electromagnetic signal, that is generated to encode information for transmission to an appropriate receiver device for execution by a computer. The computer-readable medium may be a machine-readable storage device, a machine-readable storage board, a memory device, a combination of materials that affect a machine-readable propagating signal, or a combination of one or more of these components.

A computer program (also known as a program, software, software application, script, or code) may be written in any form of programming languages, including a compiled or interpreted language or a priori or procedural language, and may be deployed in any form, including standalone programs or modules, components, subroutines, or other units suitable for use in a computer environment.

The computer program does not necessarily correspond to a file in a file device. The program may be stored in a single file provided to a requested program, in multiple interactive files (e.g., a file that stores one or more modules, subprograms, or portions of code), or in portions (e.g., one or more scripts stored within a markup language document) of a file that hold other programs or data.

The computer program may be deployed to be executed on one computer or multiple computers located at one site or distributed across multiple sites and interconnected by a communications network.

Additionally, the logic flows and structural block diagrams described in this patent document are intended to describe corresponding functions supported by the disclosed structural means, corresponding acts supported by steps, and/or specific methods, and can also be used to set up corresponding software structures and algorithms and their equivalents.

The processes and logic flows described in this specification can be performed by one or more programmable processors executing one or more computer programs to execute functions by operating on received data and generating outputs.

Processors suitable for execution of the computer program include, e.g., both general and special purpose microprocessors and any one or more processors of any form of digital computer. In general, the processor may receive instructions and data from a read-only memory or a random access memory, or both.

Essential elements of a computer are one or more memory devices for storing instructions and data and a processor for executing instructions. In addition, the computer may be generally operably coupled to one or more mass storage devices for storing data, e.g., magnetic, magneto-optical disks or optical disks to receive data therefrom, or transmit data thereto, or to perform both such operations, or may include them. However, the computer does not need to have such a device.

The description made herein presents the best mode of the invention, and provides examples to illustrate the invention and to enable those skilled in the art to make or use the invention. The specification thus prepared does not limit the present disclosure to the specific terms presented.

Therefore, although the present disclosure has been described in detail with reference to the examples described above, those skilled in the art may make modifications, changes, and modifications to these examples without departing from the scope of the present disclosure. In short, it should be noted that, in order to achieve the intended effect of the present disclosure, it is not necessary to separately include all the functional blocks illustrated in the drawings or to follow all the orders illustrated in the drawings in the illustrated order, and even if not, they may fall within the technical scope of the present disclosure set forth in the claims.

The invention claimed is:

1. An apparatus for controlling detonator blasting based on a danger radius, the apparatus comprising:

a danger radius setting unit that sets a danger radius for a detonator or a communication module;

a blasting area setting unit that sets a blasting area in which a preset danger radius is reflected in a location value input during registration of the detonator or the communication module;

an equipment location determination unit that determines a location of equipment possessed by an operator;

a blasting start control unit that controls so that blasting of the detonator is allowed only when the equipment is not located within the set blasting area as a result of the determination; and a warning notification providing unit that provides a warning notification including guidance on blasting impossibility, a current location of an operator, and information on a distance to a location out of the blasting area and the preset boundary distance based on the current location to the operator's terminal when the equipment is located within the set blasting area or at a preset boundary distance as a result of the determination, wherein the blasting area setting unit sets an area of a rectangle circumscribed about a circle formed by the preset danger radius based on the location value input during registration of the detonator or the communication module as the blasting area, and wherein the blasting start control unit controls so that blasting of the detonator is allowed only when the equipment is not located within the set blasting area and located outside a preset boundary distance.

2. The apparatus according to claim 1, wherein the blasting area setting unit, whenever the detonator or the communication module is additionally registered, updates the blasting area by reflecting the preset danger radius in the location value input during the registration.

3. The apparatus according to claim 1, wherein the equipment determination unit determines whether or not the location of the equipment possessed by the operator is located within the set blasting area.

4. A method for controlling detonator blasting based on a danger radius, the method comprising:

setting, by a danger radius setting unit, a danger radius for a detonator or a communication module;

setting, by a blasting area setting unit, a blasting area in which a preset danger radius is reflected in a location value input during registration of the detonator or the communication module;

determining, by an equipment location determination unit, a location of equipment possessed by an operator; and controlling, by a blasting start control unit, so that blasting of the detonator is allowed only when the equipment is not located within the set blasting area as a result of the determination, wherein in setting the blasting area in which the preset danger radius is reflected in the location value input during registration of the detonator or the communication module, an area of a rectangle circumscribed about a circle formed by the preset danger radius based on the location value input during registration of the detonator or the communication module is set as the blasting area, wherein, in controlling so that blasting of the detonator is allowed only when the equipment is not located within the set blasting area as a result of the determination, control is made so that blasting of the detonator is allowed only when the equipment is not located within the set blasting area and located outside the preset boundary distance, and wherein, after determining the location of the equipment possessed by the operator, a warning notification including guidance on blasting impossibility, a current location of an operator, and information on a distance to a location out of the blasting area and the preset boundary distance based on the current location is provided to the operator's terminal when the equipment is located within the set blasting area or at the preset boundary distance as a result of the determination.

5. The method according to claim 4, wherein setting the blasting area in which the preset danger radius is reflected in the location value input during registration of the detonator or the communication module includes:

updating the blasting area by reflecting the preset danger radius in the location value input during the registration whenever the detonator or the communication module is additionally registered.

* * * * *